US006103064A

United States Patent [19]

Asplund et al.

[11] Patent Number: 6,103,064

[45] **Date of Patent: *Aug. 15, 2000**

[54] PROCESS FOR THE PRODUCTION OF PAPER

[75] Inventors: Anna Asplund; Kjell Andersson, both of Göteborg; Erik Lindgren, Bohus, all of Sweden

[73] Assignee: Eka Chemicals AB, Bohus, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 09/076,935

[22] Filed: May 13, 1998

Related U.S. Application Data

[63] Continuation of application No. PCT/SE96/01442, Nov. 8, 1996.

[30] Foreign Application Priority Data

Nov. 15, 1995 [SE] Sweden ..... 9504081

[51] Int. Cl.[7] ..... D21H 11/00

[52] U.S. Cl. ..... 162/168.3; 162/181.6; 162/181.7; 162/183

[58] Field of Search ..... 162/181.6, 183, 162/168.3

[56] References Cited

U.S. PATENT DOCUMENTS

| | | | |
|---|---|---|---|
| 4,522,686 | 6/1985 | Dumas | 162/158 |
| 4,927,498 | 5/1990 | Rushmere | 162/168.3 |
| 4,961,825 | 10/1990 | Andersson et al. | 162/175 |
| 4,980,025 | 12/1990 | Andersson et al. | 162/168.3 |
| 5,176,891 | 1/1993 | Rushmere | 423/328.1 |
| 5,368,833 | 11/1994 | Johansson et al. | 423/338 |
| 5,393,381 | 2/1995 | Hund et al. | 162/168.3 |
| 5,470,435 | 11/1995 | Rushmere et al. | 162/181.6 |
| 5,543,014 | 8/1996 | Rushmere et al. | 162/181.6 |
| 5,603,805 | 2/1997 | Andersson et al. | 162/168.3 |

FOREIGN PATENT DOCUMENTS

| | | | |
|---|---|---|---|
| 0 357 574 | 3/1990 | European Pat. Off. | D21H 23/76 |
| 0 374 458 | 6/1990 | European Pat. Off. | C08F 220/54 |
| WO 94/05595 | 3/1994 | WIPO | C01B 33/14 |

OTHER PUBLICATIONS

Abstract of DE3733587, dated Oct. 4, 1987.

English Translation of Claim of USSR No. 1694756.

Jong–Hon Shin, Changman Sohn, Sin Ho Han, Say Kyoun Ow, Application of Highly Branched Polymer to the Microparticle Retention Systems, vol. 27, No. 2, *Journal of Korea Tappi*, pp. 16–22, (1995).

*Primary Examiner*—Stanley S. Silverman
*Assistant Examiner*—Robert McBride
*Attorney, Agent, or Firm*—Ralph J. Mancini; Lainie E. Parker

[57] ABSTRACT

The invention relates to a process for the production of paper from a suspension of cellulose containing fibres, and optional fillers, which comprises adding a water-soluble cationic or amphoteric branched acrylamide-based polymer and an anionic aluminium-containing silica sol to the suspension and forming and draining the suspension on a wire.

22 Claims, No Drawings

PROCESS FOR THE PRODUCTION OF PAPER

The present application is a continuation of International Application No. PCT/SE96/01442 designating the United States and filed on Nov. 8, 1996.

FIELD OF THE INVENTION

The present invention relates to a process for the production of paper and more particularly to a process which comprises adding to papermaking stock a branched acrylamide-based polymer and an aluminium-containing silica sol.

BACKGROUND OF THE INVENTION

It is known in the papermaking art to use drainage and retention aids. Such additives are introduced into the papermaking stock in order to facilitate drainage and/or to increase adsorption of fine particles and additives onto the cellulosic fibers so that they are retained with the fibers. Hereby the productivity in the papermaking process can be considerably increased and the use of drainage and retention aids thus offers substantial economic benefits.

Another important characteristic of the papermaking process is the formation of the paper sheet produced. Formation is determined by the variance in light transmission within a paper sheet, and a low variance indicates a good formation. The formation is affected by several factors, for example the manner in which the fibers are distributed, arranged and mixed within the paper sheet. Good formation is thus aimed at in the papermaking process in order to optimize the optical properties of the paper produced.

Small dosages of drainage and retention aids are generally beneficial to formation. However, even moderate dosages of drainage and retention aids may have an adverse effect on formation. As retention increases to a high level, the formation parameter may decline abruptly from good formation to poor formation. Poor formation gives rise to deteriorated paper quality and printability. Increased roughness of the paper surface is a further effect of poor formation which can have a negative impact on subsequent surface treatment such as coating. In addition, the problems of poor formation and hence deteriorated optical properties and printability may not be overcome by coating the paper since the result, normally, will not be as good as that obtained with paper produced under conditions resulting in good formation.

U.S. Pat. Nos. 4,980,025 and 5,368,833 and European Patent No. 656872 disclose the use of cationic acrylamide-based polymers and aluminium-containing silica sols as stock additives in papermaking. These systems are among the most efficient drainage and retention aids now in use.

According to the present invention it has been found that a combination of beneficial effects in terms of improved formation and very high drainage and retention performance can be obtained when aluminium-containing silica sols are used in conjunction with branched acrylamide-based polymers as stock additives in papermaking.

SUMMARY OF THE INVENTION

The present invention relates to a process for the production of paper from a suspension of cellulose-containing fibers, and optional fillers, which comprises adding to the suspension a water-soluble cationic or amphoteric branched acrylamide-based polymer and an anionic aluminium-containing silica sol, forming and draining the suspension on a wire. The invention thus relates to a process as further defined in the claims.

DETAILED DESCRIPTION OF THE INVENTION

The present invention generally relates to a process for the production of paper from a suspension of cellulose containing fibers, and optional fillers. The process comprises forming a suspension of cellulose containing fibers, and optional fillers, adding an acrylamide-based polymer and an anionic aluminium-containing silica sol to the suspension and thereafter forming and draining the suspension on a wire, wherein the acrylamide-based polymer is a water-soluble, cationic or amphoteric, branched acrylamide-based polymer.

In comparison with processes employing the same type of aluminium-containing silica sol but using it in combination with linear acrylamide-based polymers, the process of the present invention renders possible production of a paper with improved formation at corresponding dosages of additives and improved formation at corresponding levels of retention, whereby the quality of the paper web or sheet produced can be improved while retaining the high retention performance.

Water-soluble, cationic and amphoteric, branched acrylamide-based polymers which can be used according to the invention are known in the art, for example from European patent application No. 374458 which is hereby incorporated herein by reference. The polymers can be prepared from monomers which are conventional in the preparation of amphoteric and cationic acrylamide-based polymers in combination with at least one branching agent.

Examples of conventionally-used monomers for preparing cationic and amphoteric acrylamide-based polymers include acrylamide and derivatives thereof in combination with at least one ethylenically unsaturated cationic monomer and combinations of ethylenically unsaturated cationic and anionic monomers, respectively, and optional non-ionic monomers. Examples of suitable cationic monomers include diallyldimethylammonium chloride, acryloxyethyltrimethylammonium chloride and cationic monomers based on (meth)acrylates and (meth)acrylamides of N,N-dialkylaminoalkyl compounds, e.g. quaternaries and salts thereof.

The branching agent makes it possible to impart a branched structure to the acrylamide-based polymer, e.g. by co-polymerization of a monomer mixture including a monomeric branching agent containing ethylenically unsaturated bond(s) and/or by reaction between other types of reactive group(s) present in a branching agent with reactive group(s) present in the acrylamide-based polymer during or after polymerization. Examples of suitable branching agents include compounds having at least two, and preferably two, ethylenically unsaturated bonds; compounds having at least one ethylenically unsaturated bond and at least one reactive group; and compounds having at least two reactive groups. Examples of suitable reactive groups include epoxides, aldehydes, and hydroxyl groups. It is preferred that the branching agent is difunctional, i.e., that there are two groups of the type ethylenically unsaturated bond and/or reactive group present in the branching agent. Preferably the acrylamide-based polymer contains, in polymerized form, at least one ethylenically unsaturated monomer functioning as a branching agent, and more preferably the branching agent has two ethylenically unsaturated bonds.

Examples of suitable monomeric branching agents containing two ethylenically unsaturated bonds include alkylene bis(meth)acrylamides, e.g. methylene bisacrylamide and methylene bismethacrylamide, diacrylates and dimethacrylates of mono-, di- and polyethylene glycols, allyl- and vinyl-functional (meth)acrylates and (meth)acrylamides, e.g. N-methyl allylacrylamide and N-vinyl acrylamide, and divinyl compounds, e.g. divinyl benzene. Examples of suitable monomeric branching agents containing one ethylenically unsaturated bond and one reactive group include glycidyl acrylate, methylol acrylamide and acrolein. Examples of branching agents containing two reactive groups include glyoxal, diepoxy compounds and epichlorohydrin.

The acrylamide-based polymer usually has a branching agent content of at least 4 molar parts per million, based on the initial monomer content used in the polymerization. Suitably the content is at least 8 and preferably at least 20 molar parts per million, based on the initial monomer content. The upper limit in respect of the branching agent content is suitably 200 and preferbly 100 molar parts per million, based on the initial monomer content.

The polyacrylamide used in the process preferably has a cationic charge. Suitable cationic polyacrylamides have a cationicity of from 2 to 45 mole %, i.e., polymers prepared from 2 to 45 mole % of monomers which are cationic or rendered cationic during or after polymerization. Preferably, the cationicity is from 5 to 35 mole %.

The molecular weight of the acrylamide-based polymer is suitably above 500,000, preferably above 3,000,000. The upper limit is usually 30,000,000 and suitably 25,000,000.

The amount of acrylamide-based polymer added to the stock is usually at least 0.01 kg/tonne and the upper limit is usually 30 kg/tonne, calculated as dry polymer on dry fibers and optional fillers. The amount is suitably from 0.02 to 15 and preferably from 0.05 to 8 kg/tonne.

Aqueous aluminium-containing silica sols that can be used according to the present invention are known in the art. Preferably the sol contains anionic aluminium-modified silica particles, i.e. particles based on $SiO_2$ or silicic acid containing aluminium. It is further preferred that the particles are colloidal, i.e. in the colloidal range of particle size The particles suitably have an average size of less than about 20 nm and preferably an average size within the range of from about 1 to 10 nm. As is conventional in silica chemistry, the size refers to the average size of the primary particles, which may be aggregated or non-aggregated. Examples of suitable aluminium-containing silica sols include those disclosed in U.S. Pat. Nos. 4,927,498, 4,961,825, 4,980,025, 5,176,891, 5,368,833, 5,470,435, and 5,543,014, and European Patent No. 656872, which are all incorporated herein by reference.

The particles present in the sol should suitably have a specific surface area of at least 50 $m^2/g$. The specific surface area can be measured by means of titration with NaOH in a known manner, e.g. as described by Sears in Analytical Chemistry 28(1956):12, 1981–1983 and in U.S. Pat. No. 5,176,891. The given area thus represents the average specific surface area of the particles. Suitably, the specific surface area is at least 425 $m^2/g$, preferably within the range of from 450 to 1700 $m^2/g$ and most preferably from 750 to 1000 $m^2/g$.

Preferred aluminium-containing silica sols according to the invention include sols containing particles of colloidal aluminium-modified silica and preferably such silica particles which are surface-modified with aluminium. These particles are suitably modified with aluminium to a degree of from 2 to 25%, preferably from 3 to 20%, and hereby is meant the part of aluminium atoms which have replaced silicon atoms in the surface of the particles. The degree of aluminium-modification is given in % and is calculated on the basis of 8 silanol groups per $nm^2$, as described by Iler, R. K. in Journal of Colloidal and Interface Science, 55(1976):1, 25–34.

According to a preferred embodiment of the invention, the aluminium-containing silica sol has an S-value in the range of from 8 to 45%, suitably from 10 to 40% and preferably from 15 to 35%. The S-value of a sol corresponds to the degree of aggregate or microgel formation and a lower S-value is indicatative of a greater part of microgel. It is thus preferred that the sol used in the present process has a comparatively high content of microgel. It is assumed that the microgel, the aggregates, to a substantial extent is present in the form of two- or three-dimensional structures of aggregated primary particles. The S-value can be measured and calculated as described by R. K. Iler and R. L. Dalton in J. Phys. Chem. 60(1956), 955–957. Thus, in accordance with a particularly preferred embodiment of the invention, the sol used has an S-value in the range of from 8 to 45% and contains silica particles having a specific surface area in the range of from 750 to 1000 $m^2/g$ which are surface-modified with aluminium to a degree of from 2 to 25% substitution of silicon atoms. Sols of this type are disclosed in U.S. Pat. No. 5,368,833.

According to another preferred embodiment of the invention, the sol used contains colloidal aluminium-modified silica with a high specific surface area, at least 1000 $m^2/g$ and suitably in the range of from 1000 to 1700 $m^2/g$. In the art, aluminium-containing silicas of this type are also referred to as polyaluminosilicate or polyaluminosilicate microgel, which are both encompassed by the term aluminium-modified silica used herein.

The amount of aluminium-containing silica sol added to the suspension is usually at least 0.01 kg/tonne, often at least 0.05 kg/tonne, and the upper limit suitably is 5 kg/tonne, calculated as $SiO_2$ on dry fibres and optional fillers. The amount is preferably in the range of from 0.1 to 2 kg/tonne.

According to the invention it is preferred to add the acrylamide-based polymer to the stock before the aluminium-containing silica sol, even if the opposite order of addition may be useful. It is further preferred to add the first component, e.g. the polymer, before a shear stage, which can be selected for example from pumping, mixing, cleaning, etc., and to add the second component, e.g. the sol, after said shear stage. The present process further encompasses split additions, e.g. using at least two positions for adding the polymer and/or at least two positions for adding the aluminium-containing silica sol, preferably with a shear stage between each addition. The pH of the stock can be in the range from about 3 to about 10. The pH is suitably above 3.5 and preferably in the range of from 4 to 9.

In addition to the improvements observed in terms of formation, it has been found that improved sizing can be obtained when using a sizing agent in conjunction with the additives according to the invention over additives comprising non-branched acrylamide-based polymers. Hereby lower levels of sizing agent can be used to give the same sizing response as compared to prior art processes and the present method thus offers further economic benefits. The sizing agent can be derived from natural sources, e.g. rosin-based sizing agents, and from synthetic sources, e.g. cellulose-reactive sizing agents such as ketene dimers and acid anhydrides, or any combination thereof. The use of such sizing agents are well-known in the art. Examples of suitable rosin-based sizing agents, ketene dimers and acid anhydrides are disclosed in U.S. Pat. No. 4,522,686, which is incorporated herein by reference. In the present process, it is preferred to use cellulose-reactive sizing agents such as alkyl ketene dimers and alkenyl succinic anhydrides, most preferably alkyl ketene dimers.

When using a sizing agent in the process, the amount added to the suspension can be within the range of from 0.01 to 5.0% by weight and preferably from 0.02 to 1.0% by weight, calculated as dry on dry fibres and optional fillers, where the dosage is mainly dependent on the quality of the pulp, the sizing agent used and the level of sizing desired. The sizing agents are used in the form of aqueous dispersions containing at least one dispersing agent selected from anionic, nonionic, amphoteric and cationic dispersing agents. It is preferred that the aqueous dispersion is anionic or cationic. When being used in the process, the sizing agent, acrylamide-based polymer and aluminium-containing silica sol can be added to the stock in arbitrary order.

According to a preferred embodiment of the invention, use is made of at least one additional organic polymer which can be derived from natural or synthetic sources. Examples of suitable naturally derived polymers include starches and guar gums, e.g. cationic and amphoteric starches and cationic and amphoteric guar gums. Examples of suitable synthetic polymers include any polymer acting as an anionic trash catcher (ATC). ATC's are known in the art as neutralizing and/or fixation agents for detrimental anionic substances present in the stock. Hereby ATC's can enhance the efficiency of the components used in the process. Suitable ATC's include cationic organic polyelectrolytes, especially low molecular weight, highly charged, cationic organic polymers such as polyamines, polyethylene imines, homo- and copolymers based on diallyldimethyl ammonium chloride, (meth) acrylamides and (meth) acrylates. Even if an arbitrary order of addition can be used, it is preferred to add such additional polymers to the stock prior to the branched acrylamide-based polymer.

According to another preferred embodiment of the invention, the process further comprises adding to the stock an aluminium compound. As is known in the art when using cationic or amphoteric polymers in combination with aluminium-containing silica sols as retention and drainage aids, further improvements of their effect can be obtained by introducing an aluminium compound into the stock. Examples of suitable aluminium compounds for this purpose include alum, aluminates, aluminium chloride, aluminium nitrate and polyaluminium compounds, such as polyaluminium chlorides, polyaluminium sulphates, polyaluminium compounds containing both chloride and sulphate ions, polyaluminium silicate-sulphates, and mixtures thereof. The polyaluminium compounds may also contain other anions than chloride ions, for example anions from sulfuric acid, phosphoric acid, organic acids such as citric acid and oxalic acid.

When using an aluminium compound in the process, the amount added to the suspension is dependent on the type of aluminium compound used and on other effects desired from it. It is for instance well-known in the art to utilize aluminium compounds as precipitants for rosin-based sizing agents, and polyaluminium compounds can also be used as ATC's. The amount should suitably be at least 0.001 kg/tonne, calculated as $Al_2O_3$ on dry fibres and optional fillers. Suitably, the amount is in the range of from 0.01 to 1 kg/tonne, preferably in the range from 0.05 to 0.5 kg/tonne.

Further additives which are conventional in papermaking can of course be used in combination with the additives according to the invention, such as for example dry strength agents, wet strength agents, optical brightening agents, dyes, etc. The cellulosic suspension, or stock, can also contain mineral fillers of conventional types such as, for example, kaolin, china clay, titanium dioxide, gypsum, talc and natural and synthetic calcium carbonates such as chalk, ground marble and precipitated calcium carbonate.

The process according to the invention is used for the production of paper. The term paper as used herein of course includes not only paper and the production thereof, but also other sheet or web-like products, such as for example board and paperboard, and the production thereof. The process according to the invention can be used in the production of paper from different types of suspensions of cellulose-containing fibers and the suspensions should suitably contain at least 25% by weight and preferably at least 50% by weight of such fibers, based on dry substance. The suspensions can be based on fibres from chemical pulp such as sulphate, sulphite and organosolv pulps, mechanical pulp such as thermomechanical pulp, chemo-thermomechanical pulp, refiner pulp and groundwood pulp, from both hardwood and softwood, and can also be based on recycled fibres, optionally from de-inked pulps, and mixtures thereof.

The invention is further illustrated in the following non-limiting Examples. Parts and % relate to parts by weight and % by weight, respectively, unless otherwise stated.

EXAMPLE 1

The process according to the invention was evaluated in terms of formation which was measured and calculated in accordance with the method described by S. Frölich and K. Andersson in Svensk Papperstidning/Nordisk Cellulosa, 3(1995), 28–30 using a fiber optic sensor connected to a computor. In the method, the size, shape and density (porosity) of the flocs formed in the stock are analyzed and a floc index is calculated. The floc index corresponds to the formation of the paper produced and a lower floc index indicates a better formation and improved paper quality, and vice versa.

The stock used was based on 60:40 bleached birch/pine sulphate to which 0.3 g/l of $Na_2SO_4 10H_2O$ was added. Stock consictency was 0.5% and pH 7.0. In the tests, use was made of various linear and branched cationic acrylamide-based polymers, all of which had a cationicity of 10 mole %, in conjunction with a sol of aluminium-modified silica of the type disclosed in U.S. Pat. No. 5,368,833 which had an S-value of about 25% and contained silica particles with a specific surface area of about 900 $m^2/g$ which were surface-modified with aluminium to a degree of 5%. In the tests according to the invention, use was made of a cationic branched polyacrylamide containing in polymerized form a monomer branching agent being methylene bisacrylamide. The content of branching agent was 50 molar parts per million, based on initial monomer content, and this polymer is hereinafter referred to as PAM 50. In a comparative test, use was made of a conventional cationic linear polyacrylamide comprising no monomer acting as a branching agent. This polymer is hereinafter referred to as PAM 0.

Additions of chemicals were made to a baffled jar at a constant stirring speed. The sensor, CWF, available from Chemtronics, Sweden, was immersed in the jar and the stock was allowed to pass through the sensor at a constant flow rate while the floc index was measured and calculated. The tests were conducted as follows: i) adding acrylamide-based polymer to the stock followed by stirring for 30 seconds, ii) adding aluminium-modified silica sol to the stock followed by stirring for 15 seconds while measuring and calculating the floc index. The calculated floc index is the average value obtained from 2 to 10 seconds following the sol addition. The results of the tests are set forth in Table I below.

TABLE I

| Test index no. | Sol dosage (kg/tonne) | PAM-0 dosage (kg/tonne) | PAM-50 dosage (kg/tonne) | Floc |
|---|---|---|---|---|
| 1 | 0.55 | 0.2 | | 505 |
| 2 | 0.55 | 0.35 | | 605 |
| 3 | 0.55 | 0.5 | | 760 |
| 4 | 0.55 | 0.7 | | 935 |
| 5 | 0.55 | 0.9 | | 1305 |
| 6 | 0.55 | 1.05 | | 1465 |
| 7 | 0.55 | 1.2 | | 1625 |
| 8 | 0.55 | | 0.2 | 420 |
| 9 | 0.55 | | 0.35 | 435 |
| 10 | 0.55 | | 0.5 | 615 |
| 11 | 0.55 | | 0.7 | 875 |
| 12 | 0.55 | | 0.9 | 915 |
| 13 | 0.55 | | 1.05 | 1030 |
| 14 | 0.55 | | 1.2 | 1080 |

As is evident from the table, the process according to the present invention using a branched polyacrylamide resulted in a substantially lower floc index, thereby indicating better formation and improved paper quality, as compared to the comparative process using a linear polyacrylamide.

EXAMPLE 2

Retention properties of the processes of example 1 were evaluated by means of a Britt Dynamic Jar at 1000 rpm, which is the conventional test method for retention in the paper industry. The same types of stock, polyacrylamides, aluminium-modified silica sol and dosages as used in example 1 were used in these tests. Using the order of addition as defined above, the stock was drained 15 seconds following the sol addition for measuring the retention. The retention results obtained in the tests and the floc index values of example 1 were recorded by means of a computor, the data were plotted as floc index (y) against retention (x) and a curve was adapted to the data points; $y=16.6x^{0.95}$ and correlation $R^2=0.94$ for the process according to the invention; $y=13,4x^{1.04}$ and $R^2=0.94$ for the comparative process. The relations between retention and formation are further evident from table II.

TABLE II

| Retention | Floc index | |
|---|---|---|
| (%) | PAM-0 | PAM-50 |
| 30 | 460 | 420 |
| 40 | 621 | 552 |
| 50 | 783 | 682 |
| 60 | 947 | 812 |
| 70 | 1112 | 940 |
| 80 | 1277 | 1067 |

Lower floc index values indicating better formation and improved paper quality were obtained with the process according to the invention over the comparative process at corresponding retention levels.

EXAMPLE 3

The sizing efficiency of the process according to the invention was evaluated in this test. Paper sheets were prepared from the same stock as used in example 1 according to the standard method SCAN-C23X for laboratory scale. In addition to the additives used in example 1, use was made of a cationic branched polyacrylamide having a cationicity of 10% containing in polymerized form methylene bisacrylamide, the content of which was 25 molar parts per million, based on initial monomer content. This polymer is hereinafter referred to as PAM 25. The sizing agent used was a cationic dispersion of alkyl ketene dimer.

The order of addition were as follows: i) adding acrylamide-based polymer to the stock followed by stirring for 30 seconds, ii) adding ketene dimer to the stock followed by stirring for 15 seconds, iii) adding aluminium-modified silica sol to the stock followed by stirring for 15 seconds, and iv) draining the stock to form paper. The dosages were as follows: 0.3 kg of polyacrylamide per tonne of dry stock, 0.8 kg of ketene dimer per tonne of dry stock, and 0.5 kg of silica-based sol, calculated as $SiO_2$ per tonne of dry stock.

The sizing efficiency was evaluated by means of the Hercules Size Test (HST) with test solution no. 2 (1% formic acid) to 85% reflectance. The process according to the invention using the branched polyacrylamides PAM 25 and PAM 50 resulted in HST values being 60% and 90% higher, respectively, as compared to the HST value obtained with the comparative process using the linear polyacrylamide.

We claim:

1. A process for the production of paper from a suspension of cellulose containing fibers, and optional fillers, which comprises forming a suspension of cellulose containing fibers, and optional fillers, adding an acrylamide-based polymer and an anionic aluminium-containing silica sol to the suspension and thereafter forming and draining the suspension on a wire, wherein the acrylamide-based polymer is a water-soluble, cationic or amphoteric, branched acrylamide-based polymer.

2. The process of claim 1 wherein the acrylamide-based polymer contains a bifunctional branching agent.

3. The process of claim 1 wherein the acrylamide-based polymer contains in polymerized form a branching agent selected from alkylene bis(meth)acrylamides, di(meth) acrylates of mono-, di- and polyethylene glycols, allyl- and vinyl-functional (meth)acrylates and (meth) acrylamides, or divinyl compounds.

4. The process of claim 1 wherein the acrylamide-based polymer has a branching agent content of from 8 to 100 molar parts per million, based on initial monomer content.

5. The process of claim 1 wherein the acrylamide-based polymer has a molecular weight of at least 3,000,000.

6. The process of claim 1 wherein the acrylamide-based polymer is a cationic polymer.

7. The process of claim 1 wherein acrylamide-based polymer and a sol containing anionic aluminium-modified silica particles having an average size within the range of from about 1 to about 10 nm are added to the suspension.

8. The process of claim 1 wherein the sol contains particles having a specific surface area of at least 425 $m^2/g$.

9. The process of claim 1 wherein the sol has an S-value in the range of from 8 to 45% and contains particles with a specific surface area within the range of from 750 to 1000 $m^2/g$.

10. The process of claim 1 which further comprises adding a sizing agent to the suspension.

11. The process of claim 10 wherein the sizing agent is a ketene dimer.

12. The process of claim 7 wherein the sol contains particles having a specific surface area of at least 425 $m^2/g$.

13. The process of claim 7 wherein the sol has an S-value in the range of from 8 to 45% and contains particles with a specific surface area within the range of from 750 to 1000 $m^2/g$.

14. The process of claim 8 wherein the sol has an S-value in the range of from 8 to 45% and contains particles with a specific surface area within the range of from 750 to 1000 $m^2/g$.

15. The process of claim 1 which further comprises adding at least one natural or synthetic polymer to the stock.

16. The process of claim 15 wherein said polymer is selected from the group consisting of cationic starch, amphoteric starch, cationic guar gum, amphoteric guar gum, polyamines, polyethylene imines, homo- and copolymers based on diallyldimethyl ammonium chloride, (meth) acrylates, (meth) acrylamides and mixtures thereof.

17. The process of claim 1 which further comprises adding at least one (poly) aluminum compound to the stock.

18. The process of claim 17 wherein said (poly) aluminum compound is selected from the group consisting of alum, aluminates, aluminum chloride, aluminum nitrate, polyaluminium chlorides, polyaluminium sulphates, polyaluminium compounds containing both chloride and sulphate ions, polyaluminium silicate-sulphates, and mixtures thereof.

19. The process of claim 18 wherein said polyaluminium compounds contain anions derived from an organic acid.

20. The process of claim 19 wherein said organic acid is selected from citric acid, oxalic acid or mixtures thereof.

21. The process of claim 18 wherein said polyaluminium compounds contain anions derived from sulfuric acid, phosphoric acid and mixtures thereof.

22. A method for improving paper formation which comprises forming a suspension of cellulose containing fibers, and optional fillers, adding an acrylamide-based polymer and an anionic aluminum-containing silica sol to the suspension and thereafter forming and draining the suspension on a wire, wherein said acrylamide-based polymer is a water-soluble, cationic or amphoteric, branched acrylamide-based polymer.

* * * * *